US007059506B2

(12) United States Patent
Mochizuki et al.

(10) Patent No.: US 7,059,506 B2
(45) Date of Patent: Jun. 13, 2006

(54) STAPLER APPARATUS

(75) Inventors: Naoto Mochizuki, Yamanashi Prefecture (JP); Yosuke Sajiki, Yamanasi Prefecture (JP)

(73) Assignees: ACCO Brands USA LLC, Lincolnshire, IL (US); NISCA Corporation, Yamanashi-ken (JP)

( * ) Notice: Subject to any disclaimer, the term of this patent is extended or adjusted under 35 U.S.C. 154(b) by 27 days.

(21) Appl. No.: 10/450,071

(22) PCT Filed: Dec. 21, 2001

(86) PCT No.: PCT/IB01/02622

§ 371 (c)(1),
(2), (4) Date: Jun. 9, 2003

(87) PCT Pub. No.: WO02/053327

PCT Pub. Date: Jul. 11, 2002

(65) Prior Publication Data

US 2004/0245309 A1 Dec. 9, 2004

(30) Foreign Application Priority Data

Dec. 28, 2000 (JP) ..... 2000-402782

(51) Int. Cl.
*B27F 7/36* (2006.01)

(52) U.S. Cl. ..... 227/2; 227/6

(58) Field of Classification Search ..... 227/2, 227/5, 6, 7, 120, 131, 155, 4; 270/37, 53, 270/58.08, 58.09; 271/265.02, 265.05
See application file for complete search history.

(56) References Cited

U.S. PATENT DOCUMENTS

| | | | | |
|---|---|---|---|---|
| 4,570,841 | A | 2/1986 | Olesen | |
| 4,770,334 | A | 9/1988 | Hoshi et al. | |
| 4,913,332 | A | 4/1990 | Olesen | |
| 4,978,045 | A | 12/1990 | Murakami et al. | |
| 5,121,868 | A | 6/1992 | Jairam | |
| 5,230,457 | A * | 7/1993 | Hiroi et al. | 227/2 |
| 5,346,114 | A * | 9/1994 | Udagawa et al. | 227/120 |
| 5,474,222 | A | 12/1995 | Kanai et al. | |
| 5,975,396 | A * | 11/1999 | Manabe | 227/2 |

FOREIGN PATENT DOCUMENTS

JP 09038912 A * 2/1997

* cited by examiner

*Primary Examiner*—Rinaldi I. Rada
*Assistant Examiner*—Nathaniel Chukwurah
(74) *Attorney, Agent, or Firm*—Michael Best & Friedrich LLP

(57) ABSTRACT

A stapler apparatus is configured for recovering a binding mechanism reciprocally driven by a drive motor to an idling position region by inertial movement of the binding mechanism after a stop of the drive motor. The stapler apparatus includes an actuating position sensor that detects an actuating position of the binding mechanism before reaching the idling position region to attain a timing to stop the drive motor.

8 Claims, 7 Drawing Sheets

STAPLER APPARATUS

BACKGROUND OF THE INVENTION

The present invention relates to a stapler apparatus which binds media to be bound (a sheet bundle), such as a plurality of documents printed with a copying machine, a printer, or a composite of machines thereof, etc., with staples.

Conventional stapler apparatuses of this type comprise a built-in direct current motor, the drive of the direct current to recover to within an idle position region which is the initial position after the binding process by the binding means, are equipped with a nipping means to hold the binding media, a forming means to form staples into U-shapes, a driving means to drive U-shaped staples into the binding media being nipped and a binding means comprising a bending means to bend the leading ends of staples driven into the binding media and are disposed with an idle position sensor that can detect that the binding means has stopped within the idle position region. Using the output from this idle position sensor, it grasps the position where the binding means has entered within the idle position region and stops the supply of electric power to the direct current motor. At the same time, an electric brake is applied by electrically shorting the input terminal, or by applying a reverse drive to stop the direct current motor, the rotation thereof continues under inertia. Note that the idle position region is set to a regional width wherein the binding means can surely stop in prior consideration of the movement by inertia.

However, in recent years, the processing speeds of system apparatuses incorporating stapler apparatuses have become faster and varied, so to handle specifications for those processing speeds, the rotation count of the direct drive motor, which is the drive source for the stapler apparatuses themselves, is increased to increase the binding speeds thereby making it possible to handle the processing speeds of system apparatus to which they are incorporated.

However, although it is possible to increase binding speeds by increasing the number of rotations of the direct current motor, inertia also increases, thus it takes a longer amount of time for the direct current motor to stop from beginning the stopping operation until rotation is completely stopped under inertia. Nevertheless, it is structurally impossible to increase the idle position region for the increased stopping time in view of the space of the stapler apparatus itself. The result is that in using such idle position sensors like those of the prior art to grasp the position that the binding means has reached in the idle position region to begin stopping the direct current motor, the binding means will not stop within the idle position region and will over run it because of the inertia before stopping. This causes the problem of a narrowing of the opening of the nipping means that nips the binding media for the amount that was overrun thereby making it impossible to set the binding media.

SUMMARY OF THE INVENTION

In view of the aforementioned problems, this invention provides a stapler apparatus that can recover the binding means securely to the idle position region for smooth binding, even if the binding speed is increased in accordance to the processing speed of the system apparatus that incorporates the binding speed of the stapler apparatus.

In one embodiment, the invention provides a stapler apparatus that recovers a binding means reciprocally driven by a drive motor to within an idle position region by inertia after stopping that drive motor, equipped with an operating position sensor that detects the actuating position of the aforementioned binding means before the idle position region and that can acquire the timing to stop the aforementioned drive motor.

According to this invention, as a sensor for acquiring the timing to begin the stopping operation of the drive motor, along with a conventional idle position sensor, an actuating position sensor is disposed to detect the actuating position of the binding means that can start the stopping operation of the drive motor with the timing that will allow the recover of the closing means to within the idling position region, before the idling position region, thereby making it possible to attain the output to stop the drive motor with the timing that was not possible to attain with conventional idling position sensors and that can recover the binding means to within the idling position region accurately despite increases in the binding speed of the stapler apparatus in accordance with the processing speed of the system apparatus and increased inertia.

In another embodiment, the invention provides a stapler apparatus that recovers a binding means reciprocally driven by a drive motor to an idling position region under inertial movement after that drive motor is stopped, an idling position sensor that detects that the aforementioned binding means is recovered to within the idling position region and an actuating position sensor that detects the actuating position of the aforementioned binding means before the idling position region are disposed to enable attaining the timing to stop the drive motor based upon the output of the aforementioned idling position sensor and the aforementioned actuating position sensor.

According to this invention, along with the conventional idling position sensor, as a sensor to attain the timing to start the stopping operation of the drive motor, an actuating sensor that detects the actuating position of the binding means to start the stopping operation of the drive motor is disposed, in consideration of the inertia according to the drive conditions of the controlled drive motor to correspond to the system apparatus processing speed incorporated therein, and by selectively using the output of the idling position sensor attain the output for stopping to enable recovery of the binding means within the idling position region and the output of the actuating position sensor, it is possible to select in advance when incorporating to a system apparatus and to control based upon the output of a sensor in a position near the recovery of the binding means within the idling position region and to recover the binding means accurately within the idling position region.

In yet another embodiment, the invention provides a stapler apparatus that recovers a binding means reciprocally driven by a drive motor to an idling position region under inertial movement after that drive motor is stopped, an idling position sensor to detect that the aforementioned binding means is recovered to within the idling position region and an actuating position sensor to detect the actuating position of the aforementioned binding means before the idling position region and a stopping position sensor to detect that the binding means has stopped within the idling position region the actuating position sensor detecting from the actuating position of the binding means to the idling position region detected by the aforementioned idling position sensor, are disposed. When restarting after stopping partway, other than when the aforementioned stopping position sensor detects the binding means is stopped, the aforementioned drive motor drives in the direction opposite to the normal rotating direction, and based upon the first output of either the aforementioned idling position sensor or the actuating position sensor, or when a stop is detected, the aforementioned drive motor drives in the normal rotation direction. It is possible to attain each of the timing to stop the drive motor based upon the output of the aforementioned idling position sensor.

According to the present invention, when restarting after stopping partway, other than when the aforementioned stopping position sensor detects that the binding means is stopped, the aforementioned drive motor drives in a direction opposite the normal direction of rotation, but based on the first output of the outputs of either the aforementioned idling position sensor or the actuating position sensor, or when a stop is detected, the aforementioned drive motor drives in the direction of normal rotation. It is possible to attain the timing to stop the drive motor based upon the output of the aforementioned idling position sensor and if, for example, there is an emergency system apparatus stop, at the restart after stopping partway because of an operation stop caused by a stapling problem on the stapler apparatus, etc, it recovers the binding means accurately to within the idling position region without performing the binding operation again.

Below, an embodiment of the stapler apparatus according to the present invention will be described in accordance with the figures.

DESCRIPTION OF THE REFERENCE NUMERALS

100 Staple cartridge
200 Cartridge holder
300 Stapler unit
320 Electric drive unit
CA30 Drive position detection cam
SE Drive detection sensors
SE1 Idling position sensor
SE2 Operating position sensor
SE3 Stop position sensor

DETAILED DESCRIPTION

Figure 1:
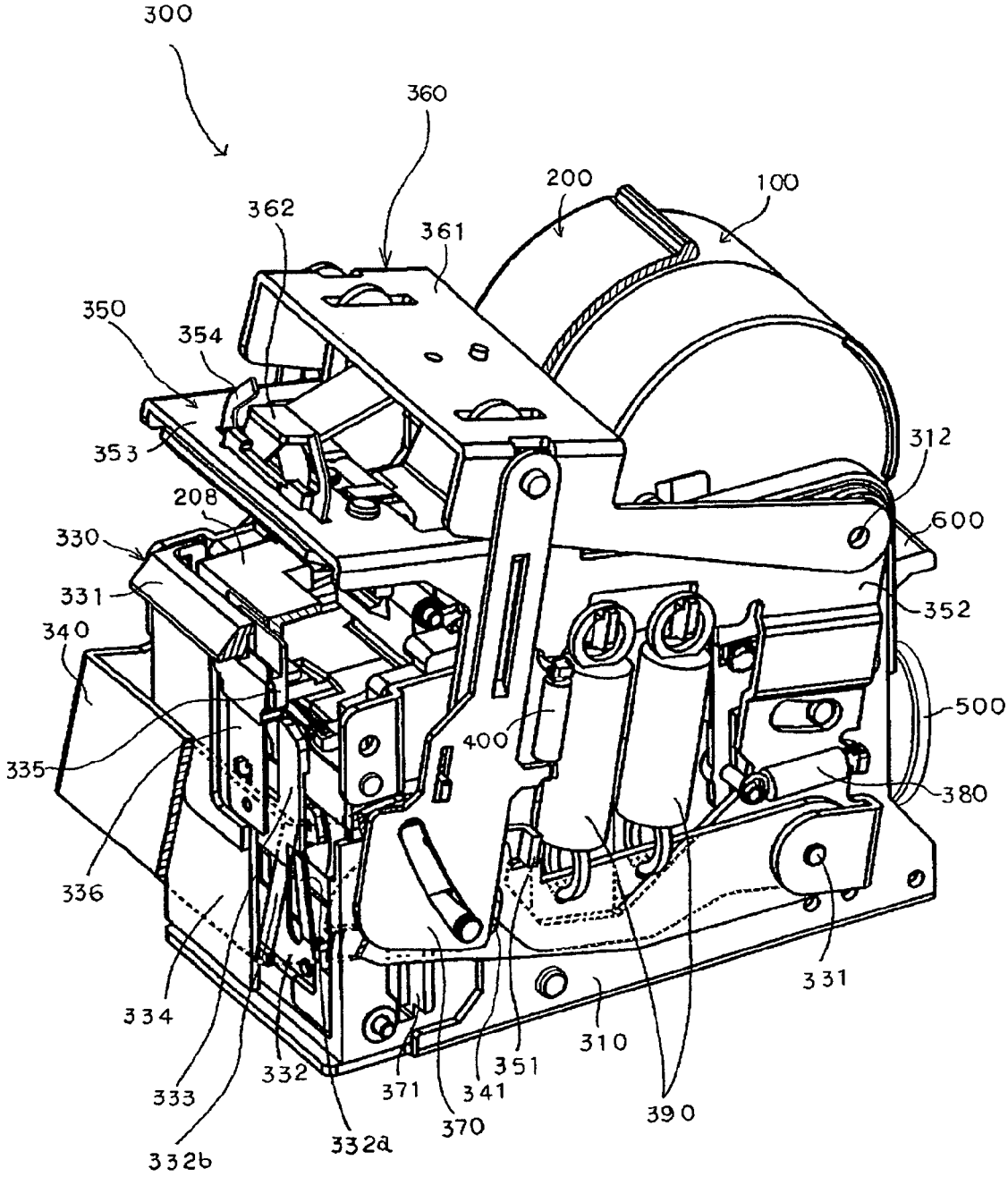
FIG. 1 is an external perspective view of a sectional portion comprising the stapler apparatus according to the invention.

FIG. 1 is an external perspective view showing a section of part of the entire stapler apparatus, mainly comprising the staple cartridge 100, the cartridge holder 200 and the stapler unit 300.

Figure 4:
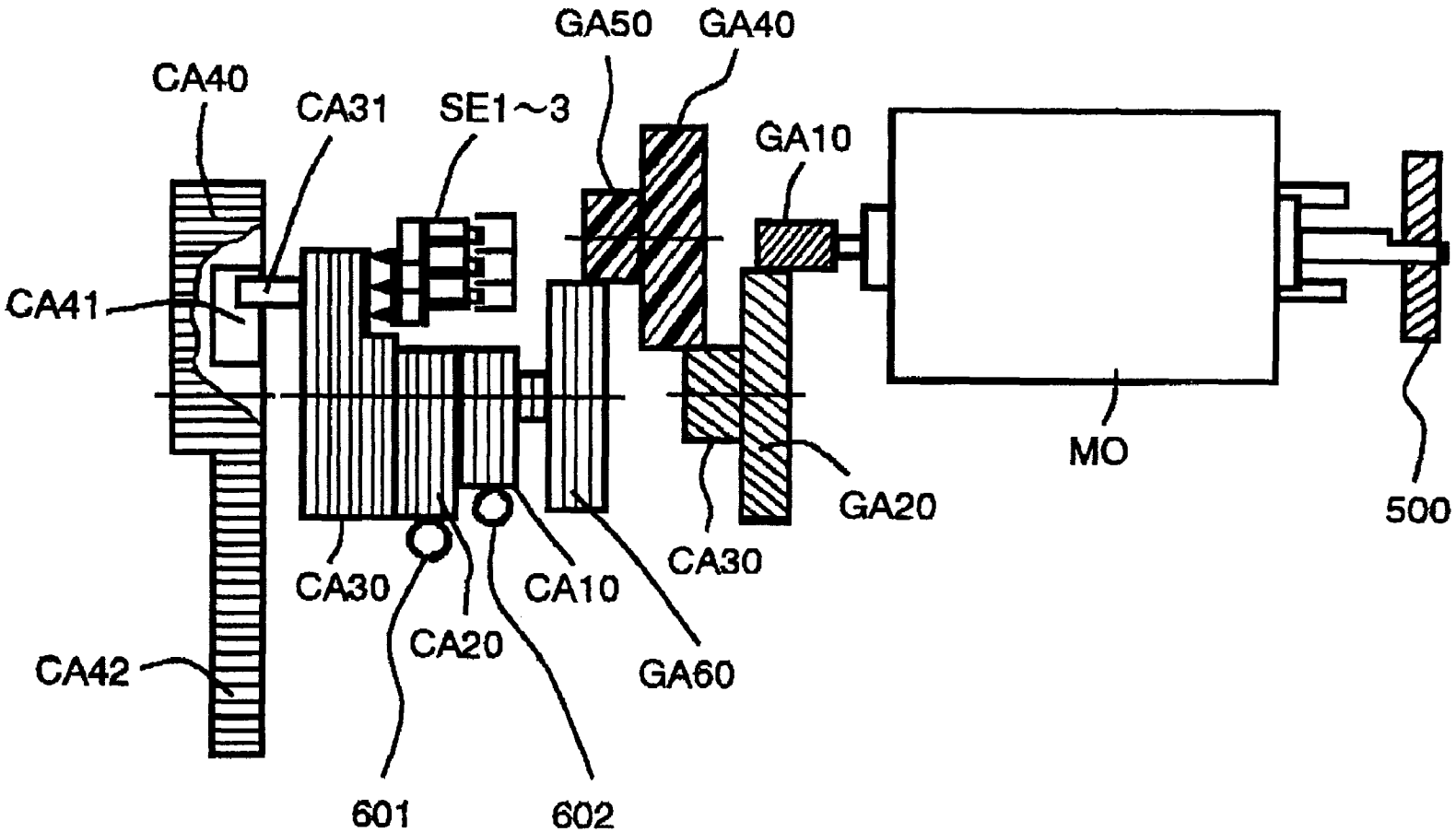
FIG. 4 is a conceptual view to explain the drive transmission system of the electric drive unit of the stapler apparatus according to the invention.

Firstly, to describe the apparatus according to the sequence of its assembly, the stapler unit 300 comprises the unit frame 310, the electric drive unit, shown in FIG. 4, the staple head unit 330, the actuating lever 340, the anvil unit 350, the clincher unit 360, the interlock lever 370, the anvil spring 380, the paper thickness absorbing spring 390, the clincher spring 400 and the manual drive plate 500.

Figure 2:
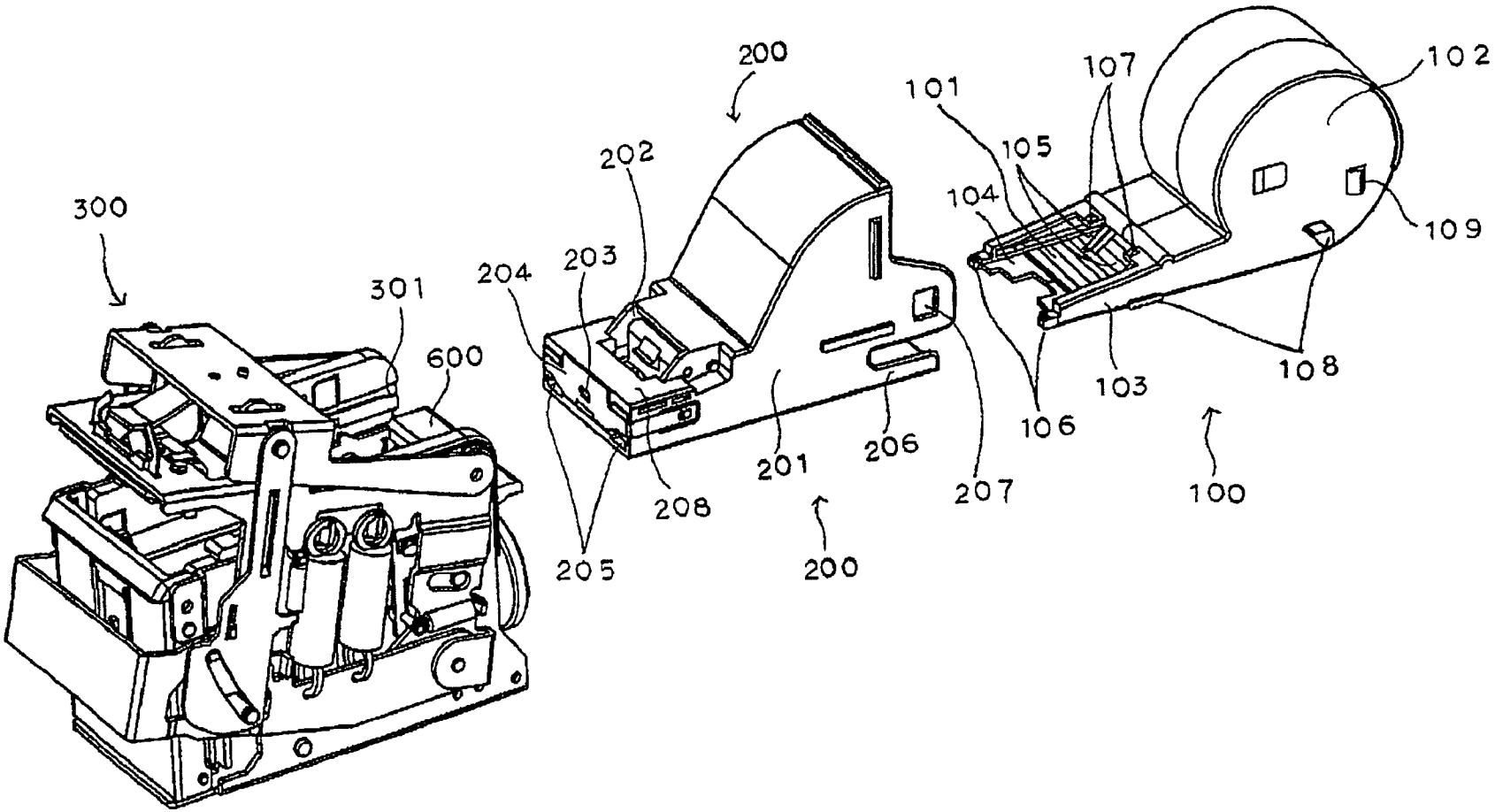
FIG. 2 is an external perspective view of the disassembled units of the stapler apparatus according to the instant invention.

The unit frame 310 is sheet metal pressed formed into a sectional U-shape comprising sides established left, right and a bottom. It internally holds the electric drive unit, thereabove the holder guide 301, which is shown in FIG. 2 and the staple head unit 330 in the leading edge and properly supports other units on the outside side walls.

Note that the electric drive unit, shown in the FIG. 4, is composed of a direct current motor MO that is the stapler drive source, the gear train that decelerates the rotation of the motor MO to a determined rotating speed and the transmission cams CA10 to CA 40 that are decelerated to the determined speed and rotate. Using these drive transmission cams CA10 to CA 40, the motor drives the staple head unit 330 and the anvil unit 350 via the actuating lever 340 and the interlock lever 370 and by driving the clincher unit 360, it controls the series of operations of the stapler.

The staple head unit 330 comprises the sheet loading table 331, the driver 332, the former 333, the sheath 334 and the bending block 335.

The pin of the drive position detection cam CA30 disposed on the final stage of the electric drive unit mates with the driver drive cam CA40 and the staple head unit 330 moves and displaces upwardly the driver 332, formed with a leaf spring material.

Displacement of the driver 332 abuts the former abutting piece 332*a* on the driver 332 against the former 333. The driver 332 and former 333 follow a stepped surface, not shown in the figures, formed on the sheath 334 upward to a position where that abutment is released.

The former 333 bends into a U-shape staples drawn to the staple bending position of the bending block 335 and holds to guide U-shaped staples on the sides of the former 333 thereof to enable driving. Note that the position where the staple is bent by the former 333 corresponds to the staple driving position below.

In this state, the driver 332 released from abutting the former 333 by the protrusion, not shown in the figures, formed at the sheath 334 is displaced further upward leaving the former 333 in that position.

By displacing upward, the staple driving unit 332*b* positioned at the leading edge of the driver 332 displaces the bending block 335 to the front from the region of movement of the driver 332 and retracts.

The staple driving unit 332*b* of the driver 332 displaced further upward separates from the adhesive staples that have been bent and are adhering to the next staple by adhesive tape. Formed and separated staples are driven by the binding media.

Next, the actuating lever 340 has arms extending left and right along the side surfaces of the anvil unit 350. While nipping in the unit frame 310, they are supported by the interlocking pivot shaft 331 disposed on the anvil unit 350 sides.

In addition, the paper thickness absorbing springs 390 are stretched between the anvil unit 350 in a central location on the left and right arms of the actuating lever 340. These springs 390 constantly urge in the counterclockwise direction around the interlocking pivot shaft 331 to contact with the stopper 351 formed on the anvil unit 350.

The notch 341 comprising an edge to abut the anvil drive lever 601, shown in FIG. 4, drivingly displaced by the electric drive unit, is formed on the leading edge of the arm positioned on the other edge of the left and right arms. The anvil drive lever swings it clockwise around the interlocking pivot shaft 331 which is pressed and urged downward.

The anvil unit 350, the anvil rocking pivot 352 on one side thereof rockingly supported on the pivot shaft 312 on the unit frame 310, is constantly rotatingly urged in the clockwise direction by the anvil spring 380 around the pivot shaft 312.

The anvil head 353 on the other side follows the rocking of the actuating lever 340 and rocks counter-clockwise resisting the urging force of the anvil spring 380 to nip and support the binding media at a position that corresponds to the thickness thereof.

Note that after the anvil unit 350 nips and supports the binding media by the paper thickness absorbing springs 390, the actuating lever 340 continues acting alone in resistance to the resilient force of the paper thickness absorbing springs 390 because the anvil unit 350 is locked in that nipping position.

To the anvil head 353 that nips the binding media on the anvil unit 350, the clincher unit 360 that has the left and right paired clinchers 354 for bending the leading edges of staples that have penetrated the binding media driven from below the binding media, is disposed to follow.

The clincher unit 360 comprises the clincher lever 361 and is supported by the pivot shaft 312 on the unit frame 310 which is also the pivot for the anvil rocking pivot 352 on the anvil unit 350. To the leading edge of the clincher unit 360 is mounted the clincher head 362 that bends staples that have been driven and rocks the clincher 354 mounted to the anvil head 353 on the anvil unit 350.

The clincher head 362 is press formed using a steel plate for a spring with a thickness of 1.5 mm while the clincher lever 361 is formed using a plated steel plate of a thickness of 2.0 mm, to absorb the difference in pressing stroke of the clincher 354.

Next, the interlock lever 370 follows the rocking of the anvil unit 350 via the clincher spring 400 to rock the clincher unit 360 and is disposed to continue rotating with the rocking of the clincher drive lever 602, shown in FIG. 4, while the anvil unit 350 nips and stops the binding media and after the anvil unit 350 stops at the nipping position that corresponds to the thickness of the binding media, it continues rotating to bend the staples.

The manual drive plate 500 is for resetting stapling defects by manually operating the stapler when a staple is not properly driven by the binding means and the defective staple prevents the stapler apparatus from operating and thus causes a stapling problem, when driving staples. It is mated to the rotating shaft extending to the back side of the output shaft of the direct current motor of the electric drive unit, shown in FIG. 4, when manual operations are necessary.

FIG. 2 is an exploded perspective view showing the cartridge holder 200 and staple cartridge 100 that are mounted on the stapler unit 300 in FIG. 1, pulled out.

When pulling from the stapler unit 300, first the cartridge lock lever 600 which abuts the staple cartridge 100 and urgingly supports in the mounting direction is manually pressed downward to release the abutting, then the staple cartridge 100 is pulled from the cartridge holder 200.

Then, the cartridge holder 200 is pulled from the stapler unit 300. Conversely, it is also possible to remove the staple cartridge 100 from the cartridge holder 200 after pulling out the cartridge holder 200 while the staple cartridge 100 is mounted to the cartridge holder 200.

Note that the reverse procedures are acceptable when mounting the staple cartridge 100 and cartridge holder 200 to the stapler unit 300.

The staple cartridge 100 is composed of a semi-transparent plastic case and comprises the storage unit 102 that stores the staple band material 101 into which sheets of a plurality of straight staples linked into a band are wrapped into a roll, and the pull-out guide 103 for pulling out the staple band material 101.

The pull-out guide 103 is mounted to the cartridge holder 200 and is equipped with the opening 104 the guide surface on the leading top side being widely cut away to abut the staple feed means 202 on the cartridge holder 200, the back-feed stopper pawl 105 to arrest so that the staple band material 101 pulled out from the storage unit 102 does not return back into the storage unit 102, and the leading edge stopper 106 that restricts the leading edge of the staple band material 101 that has been pulled out and that positions the leading edge thereof at the binding position while mounted to the stapler unit 300.

Also, it comprises the feed pawl advancing protrusion 107 that protrudes into the guide surface on the top-side of the leading edge formed on the opening 104 on the pull-out guide 103 and advances the staple feed means 202 when mounting to the cartridge holder 200 to press the leading edge of staples in the staple band material 101 to the edge stopper 106.

Furthermore, to both sides of the staple cartridge 100 are equipped the guide protrusion 108 guided when mounting to the cartridge holder 200 and the stopper pawl 109 that is stopped when mounting to the cartridge holder cartridge holder 200.

Though not shown in the figures, it is possible to bend open the bottom portion the staple cartridge 100 from an appropriate position on the back-feed stopper pawl 105 and the edge stopper 106 to the storage unit 102. By opening, the back-feed stopper pawl 105 is released from stopping the staple band material 101 thereby making it possible to discard all remaining staples when discarding.

The cartridge holder 200 is composed of the holder unit 201, the staple feed means 202, the magnet 203, the guide plate 204 comprising a non-magnetic body, the opening 205, the guide 206, the abutting hole 207 and the auxiliary table 208.

The holder unit 201 is formed of a plastic material to cover the front half of the staple cartridge 100.

The staple feed means 202 is rockingly supported on the holder unit 201 and is constantly urged to the staple pull-out direction by a leaf spring, which is not shown in the figures. It is interlocked to the nipping action of the binding means by the anvil unit 350 and charged. It comprises a feed pawl for pressing the staple sheet surface of the staple band material 101 with the recovery action caused by the release of the charge to advance the staple band material 101.

The magnet 203 and the guide plate 204 faces the staple to be driven at the binding position when mounted to the stapler unit 300 and the magnetic attraction of the magnet attracts mis-driven staples to discharge them outside from the stapler unit 300.

The opening 205 is for setting the leading edge of the stopper 106 on the staple cartridge 100 and the leading edge of the staple to protrude and be set at the binding position The guide 206 is for guiding the guide protrusion 108 on the staple cartridge 100 and is composed of a cut-out groove and a bottom surface.

The abutting hole 207 abuts the stopper pawl 108 on the staple cartridge 100 and it is one of the supplementary stopping means on the staple cartridge 100 until the staple cartridge 100 is locked by the cartridge lock lever 600.

The supplementary table 208 acts as the loading table where the binding media is loaded along with the table 331 on the staple head unit 330, as shown in FIG. 1, when mounted to the stapler unit 300.

Figure 3:
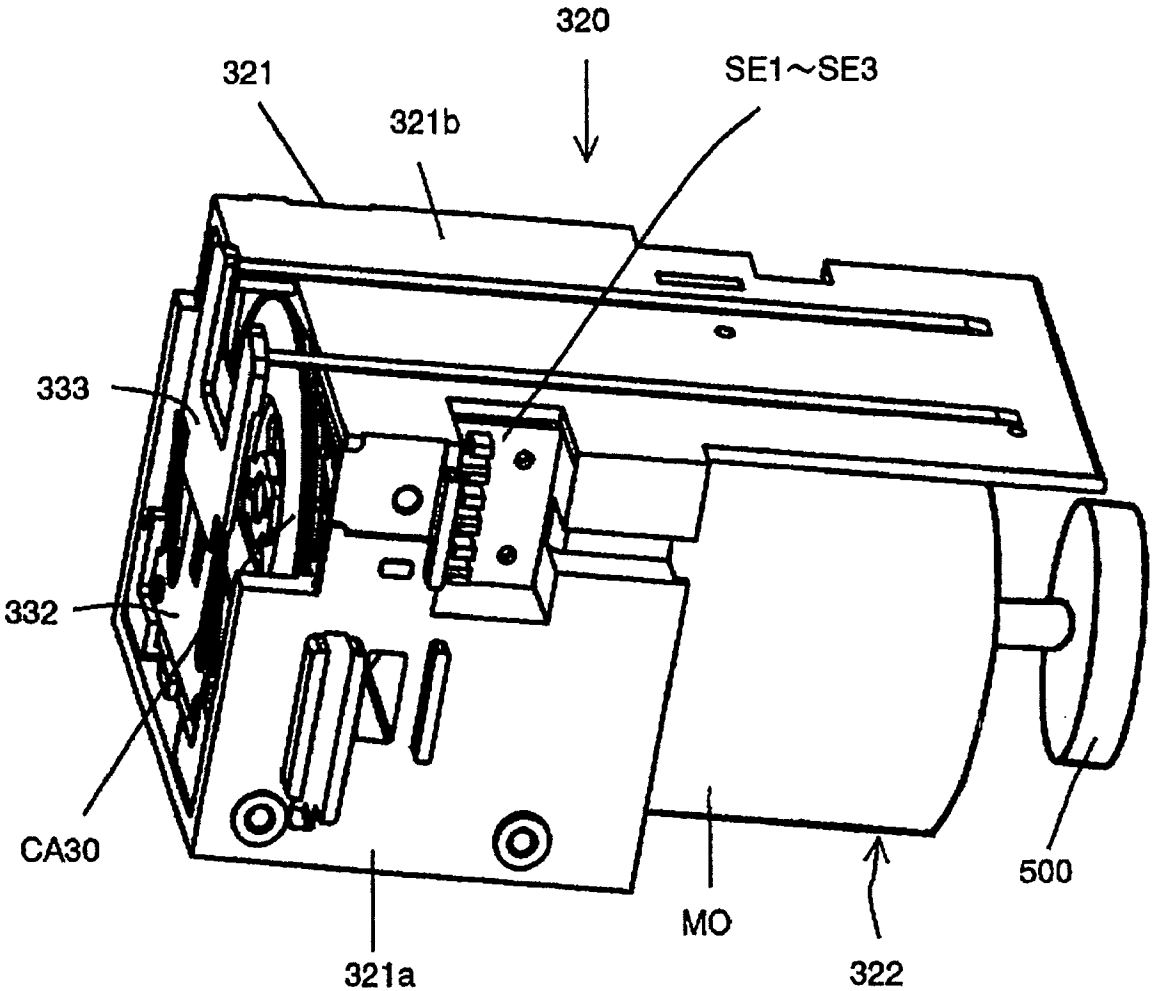
FIG. 3 is a perspective view of the electric drive unit of the stapler apparatus according to the invention.
Figure 5:
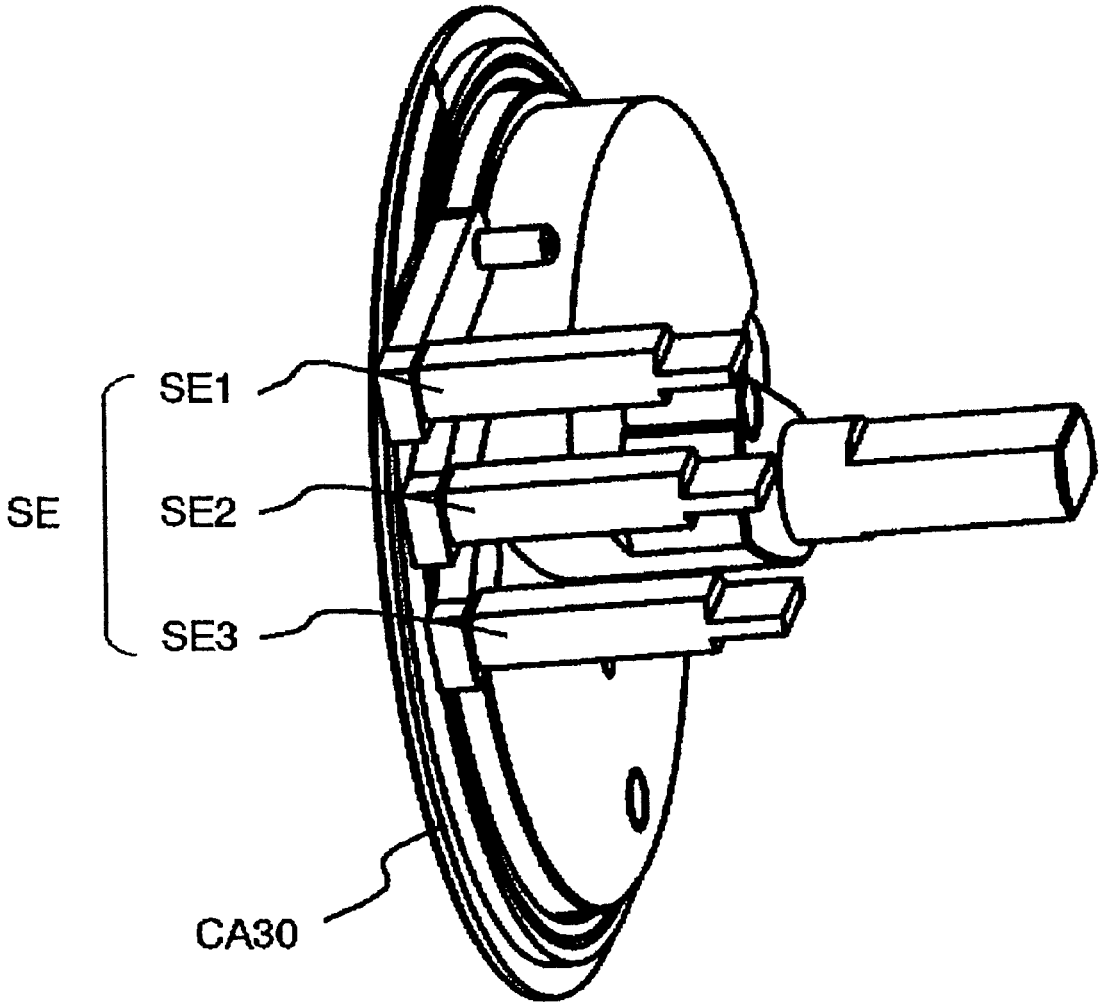
FIG. 5 is a perspective view to explain the drive detection sensors of the electric drive unit of the stapler apparatus according to the invention.

FIG. 3 to FIG. 5 explain the electric drive unit 320. FIG. 3 depicts an external view to explain the entire structure, FIG. 4 is a conceptual view to explain the drive system and FIG. 5 is a conceptual view to explain the actuator structure to detect the state of operation.

First, in FIG. 3, the electric drive unit 320 is composed of the outer cover 321, the drive system 322 and the operation state detection means SE1 to 3.

The outer cover 321, made of a resin formed member having a square shape the front, back and sides substantially completely open, is arranged at the front with the driver 332 and the former 333 the drive system support frame 321*a* with the motor MO protruding to the back side and the holder guide plate 321*b* extending a side of the upper surface thereof to the width of the staple.

The operation state detection means SE 1 to 3 are mounted to the side surface means of the drive system support frame 321*a* and penetrating the front, back and side surfaces there is a slit hole formed to guide the drive lever that drives the anvil head 350 and the clincher unit 360.

FIG. 4 shows a conceptual view of the drive system 322. It comprises the direct current motor MO, the deceleration gear series GA10 to GA60, and the drive detection sensors SE1 to SE3 that detect the rotational positions of the drive cams CA10 to CA40 and the drive cam CA30 to control the drive of the direct current motor MO according to the output of the sensors and the manual drive plate 500.

FIG. 5 explains the structure for detection using the drive detection sensors SE, comprising the drive position detection cam CA30 and the drive detection sensors SE1 to SE3.

The drive position detection cam CA30 comprises three adjacent cam arc surfaces having the same center on that surface with differing diameters.

The drive detection sensors SE1 to SE3 are composed of a light emitting element, a light receiving element and three paired optical sensors and an actuator that actuates each of these optical sensors.

This actuator constantly presses against one side with an L shaped lever by an urging spring, which is not shown in the drawings, on the drive position detection cam CA30 cam arc surfaces the other side comprising a protruding portion to activate the optical sensors.

Of these three drive detection sensors SE1 to SE3, the drive detection sensor SE1 is the idle position sensor to detect that the stapler apparatus is at the idling position capable for the stapling process or having performed the staple process and has recovered to the initial idling position.

The drive detection sensor SE2 is disposed to enable detecting the binding position before the idling position to acquire the timing to apply the brake to the direct current motor MO just before the idling position so that when the stapling process is completed and the stapler is returning to the idling position at high speed, it will not overrun the idling position under the drive inertia of the direct current motor MO to accurately stop it at the idling position. In this case, it is arranged in a position to detect the state prior to releasing the anvil unit 350 (see FIG. 1) nipping of the stapled media. It is an activation position sensor that is used to apply a brake after a prescribed delay time based on detection signal, via a delay circuit.

Because one of either the drive detection sensor SE1 that is the idling position sensor and the drive detection sensor SE2 that is the operating position sensor can be used to output a stop in the timing to recover the binding means within the idling position region in consideration of inertia corresponding to the controlled drive motor drive conditions to correspond with the processing speed of the system apparatus by selecting in advance when incorporating them into the system apparatus, it is possible to recover the binding means correctly to within the idling position region.

When restarting after a stop partway, other than when the aforementioned stopping position sensor detects a stop of the binding means, the aforementioned drive motor drives in the direction opposite to the normal direction of rotation. Based upon the first output of either the aforementioned idling position sensor or the actuating position sensor, the aforementioned motor drives in the normal direction of rotation. The drive detection sensor SE3 can attain the timing to stop the drive motor based upon the aforementioned idling position sensor output. If, for example, there is an emergency system apparatus stop, at the restart after stopping partway because of an operation stop caused by a stapling problem on the stapler apparatus, etc, the SE3 is a stopping position sensor to detect the position to apply a brake to recover the binding means accurately to within the idling position region.

Figure 6:
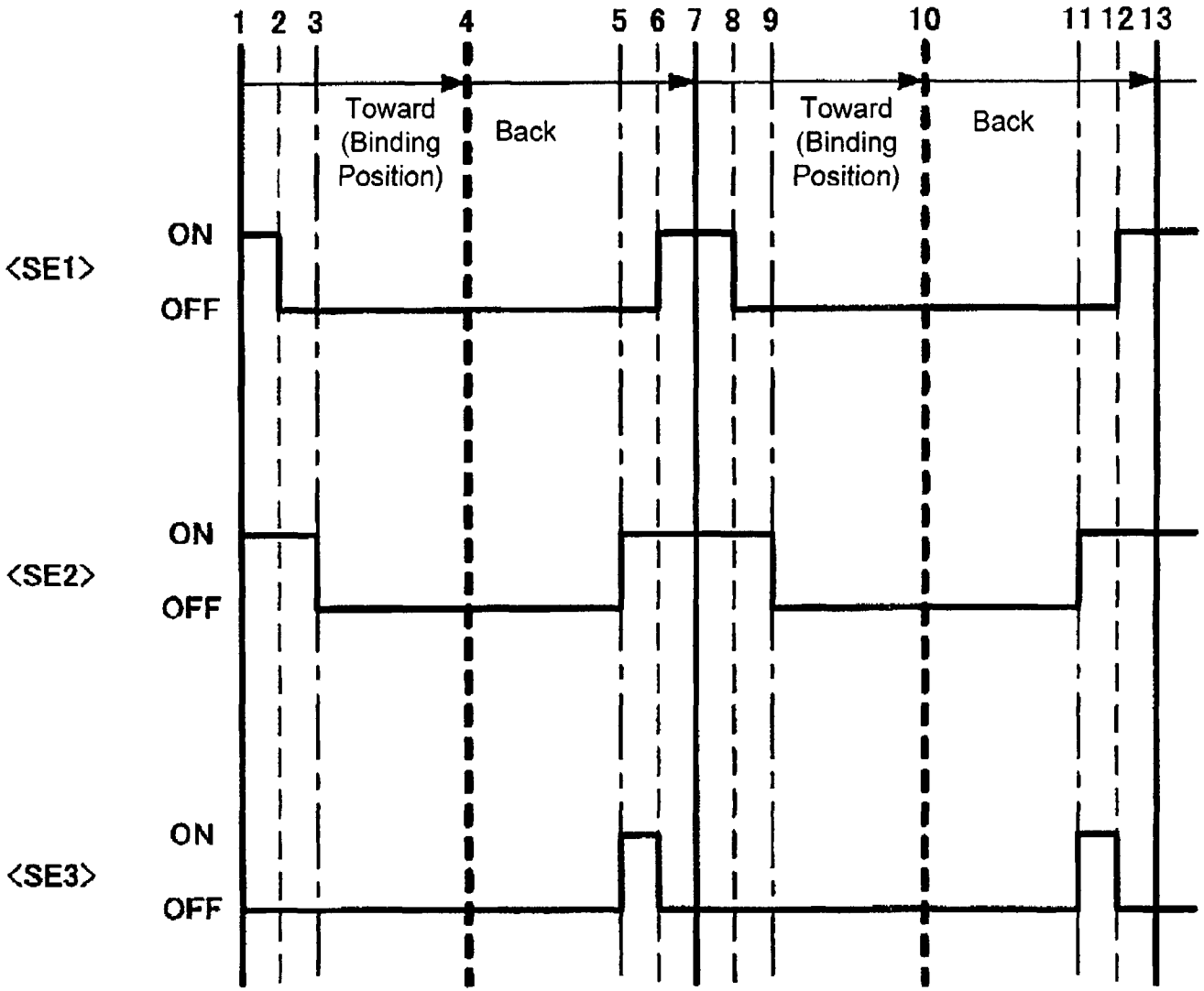
FIG. 6 is a timing chart of the drive detection sensors of the electric drive unit of the stapler apparatus according to the invention.

FIG. 6 depicts the timing chart of the drive detection sensors SE. It explains the series of detecting operations of each of the drive detection sensors SE in view of the operating states of the binding means composed of the nipping means to nip a binding media, the forming and driving means to drive U-shaped staples into the nipped binding media and the bending means to bend the leading edges of staples driven into the binding media.

First, by receiving the binding signal from the system apparatus, the binding operation starts. In state 2, by separating from the idling position region, the drive position detection cam CA30, described in FIG. 4, turns the idling position sensor SE1 OFF. In state 3, the operating position sensor SE2 is set to ON. Up to state 4, by reciprocal movement of the binding means, the binding media is nipped, the staple is formed, the formed staple is driven into the nipped biding media, and the leading edges of the drive staples penetrating the binding media are bent to complete the binding process.

Next, the binding means having completed the binding process begins to reciprocally move in the opposite direction with state 4 as a boundary. Corresponding in advance to the high speed specifications of the system apparatus the drive position detection cam CA30 switches the drive position sensor SE2 ON to detect that the binding means is positioned before the idling position region. Based on this output, the drive motor MO is stopped while the stop position sensor SE3 is switched ON to determine the direction of rotation of the drive motor when restarting after a stop partway, which is described below. At state 6, it is reset to OFF and at the same time that it recovers to within the idling position region, the idling position sensor SE1 is switched ON.

Then, based on the previous output of the operating position sensor SE2, it is stopped. The binding means whose movement continues with the drive motor MO continuing drive under inertia recovers to the initial position at state 7 to complete the series of the binding operation. It repeats the next binding operations from state 7 to state 13.

If, for some reason, it stops operation partway, to recover back to the initial position, it detects the output of the stop position sensor SE3 when restarting after stopping partway. From state 5, where the stop position sensor SE3 output switches to ON, if the binding means is in a state other than the range of state 6, the drive motor MO is rotated in the direction opposite of the normal binding process rotation regardless of the status of the stop and in the return operation, it stops the drive motor MO based upon the output attained first from the output of the idling position sensor SE1 or the operating position sensor SE2.

However, if in the range from state 5 to state 6 where the stop position sensor SE3 is switched to ON, both the driver 332 and the former 333 are passing through the position and returning where the next staple is drawn to staple. If returned back in this state, it returns to the direction to perform a normal binding process without returning back and only stopping because the next staple is going to be stapled. The drive motor MO is stopped based upon the output of the idling position sensor SE1 and the binding means is recovered to the position of state 7.

Figure 7:
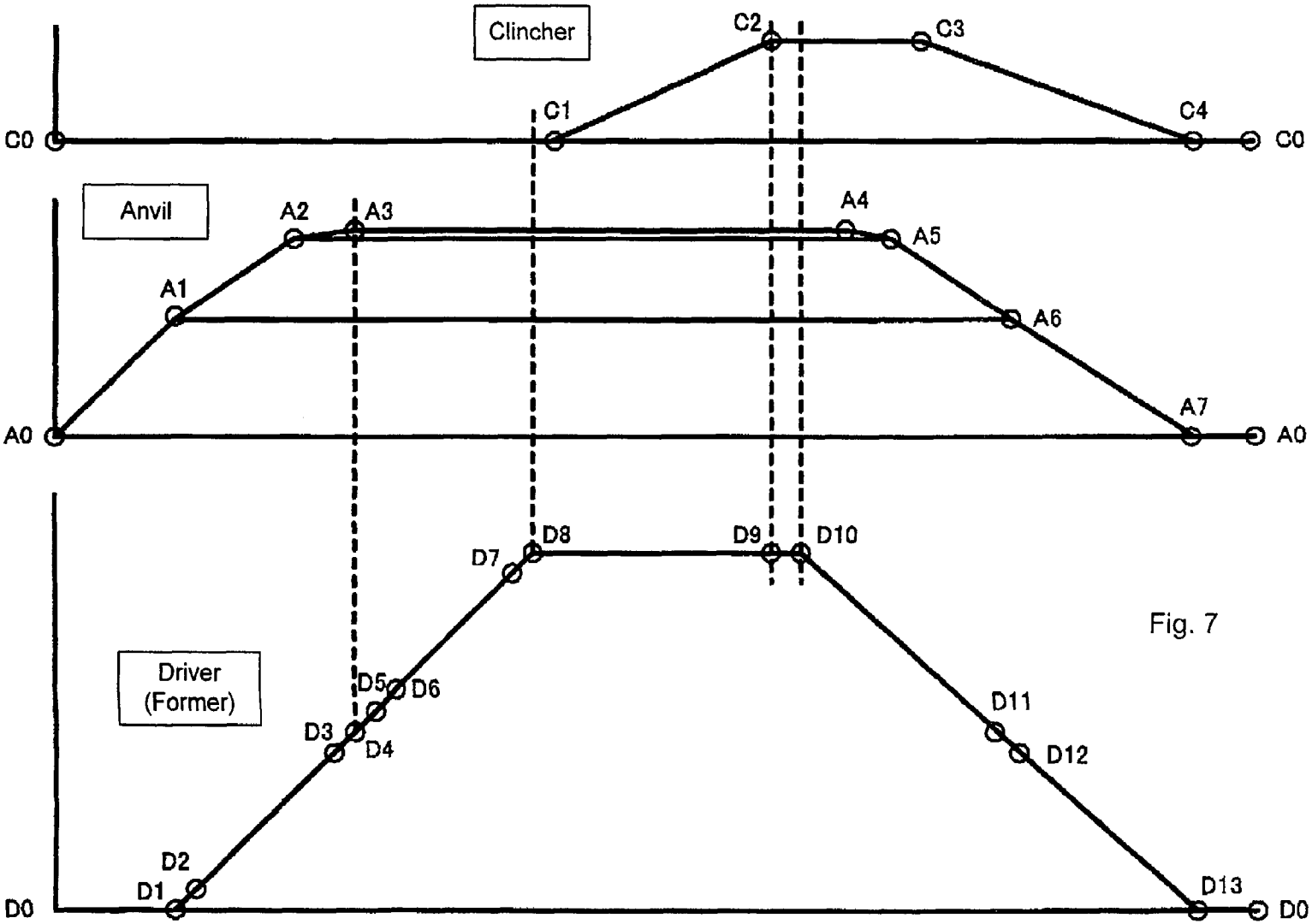
FIG. 7 is a timing chart of the series of operations of the stapler apparatus according to the invention.

FIG. 7 is a timing chart to explain the operation of each of the driver, former, anvil and clincher units' processes. The horizontal axis indicates the angle of rotation of each drive cam and the vertical axis shows the amount of displacement of each levers. The following generally describes the series of operations according to FIG. 1 and FIG. 4.

Initially, along with the setting to the stapling position of the binding media a staple execution instruction signal is output to the stapler apparatus from an outside source.

This instruction signal starts rotating the direct current motor MO shown in FIG. 4 and first, the anvil drive cam CA20 lowers the anvil drive lever 601.

The anvil drive lever 601 penetrates the anvil drive lever swing slit 371, shown in FIG. 1 and presses the activating lever 340 slot 341 and resists the anvil spring 380 to push the activating lever 340 downward.

Following the displacement of the actuating lever 340, the anvil unit 350 moves downward to start nipping the binding media.

Note that interlocked to the nipping of the anvil unit 350, the clincher unit 360 interlocked by the interlock lever 370 and the clincher spring 400 follows the anvil unit 350.

In describing the operation of the anvil unit 360, beginning from the idling position A0, rocking stops at a nipped position according to the thickness (the number of sheets) of the binding media set at the binding position, between the position A1 where, for example, 100 pages of binding media are nipped to the position A2 where 0 pages are nipped of binding media.

After nipping the binding media by the anvil unit 360, only the actuating lever 340 continues displacement resisting the paper thickness absorbing springs 390. The anvil unit 360 maintains a displaced state to the position equivalent to the position A3 by applying an over-stroke to the position A2 to enable the secure nipping even if there are 0 pages of binding media, in consideration of variations in parts and their assembly, to complete the nipping operation of the binding media using the anvil unit 360.

Before operating to the position A3 to complete the nipping operation of the binding media using the anvil unit 360, the driver drive cam CA40, shown in FIG. 4 displaces the driver 332, shown in FIG. 1, upward, and the former 333 following this displacement is pressed upward.

The driver 332 begins moving from the position D1 when the anvil unit 360 is beyond the position A1, at position D2, the former 333 presses the staple drawing to the driving position and starts forming the staple into a U-shape. In the continuing stroke, by pushing both leading edges of bent staples against the sides of the bending block 335 to guide it, both leading edges of the staple are secured front, back left and right by the former 333, the bending block 335 and the guide plate 204 on the cartridge holder 200.

Then, the leading edges that touch the formed staple of the driver 332 are pressed into the oblique surfaces of the bending block 335. The leading edge portion of the driver 332 touches the formed staple at the position D3 with the bending block 335 retracted from the area of movement of the leading edge of the driver 332. The leading edge of the formed staple pressed by the driver 332 delayed from the position A3 where the anvil 350 nips the binding media reaches the position D4 that touches the surface of the sheet of the binding media to start driving the formed staple into the binding media by the driver 332.

After the driver 332 starts driving the staple, at the same time that the abutting portion that was abutting the former 333 on the driver 332 is released from abutting, by the level protrusion on the sheath 334 at the slightly delayed position D5, the former 333 is released from abutting with the driver 332 at the position D6 just prior to the leading edge of the former 333 touching the surface of the sheets in the binding media and the former 333 stops and the former guides the bend staple driven by the driver 332.

Continuing on, the formed staple is driven by the driver 332, and after the formed staple crown touches the surface of the sheets in the binding media at the position D7, the driver 332 is further driven by the driver drive cam at the position D8, but because the driver 332 cannot press the formed staples in, the driver 332 comprising a leaf spring, itself is elastically deformed the amount of the over-stroke to absorb the difference of the mounting position to securely drive the formed staple.

The clincher unit 360 is rocked by the clincher drive unit 602 pressed downward by the clincher drive cam CA10 shown in FIG. 11 from position C1 immediately after the position D8 where the formed staple is driven by the driver 332, pressing the clincher 354 to complete the clinching operation at the position C2 by bending the leading edges of the staples that have penetrated the binding media.

After the clinching operation is completed, first, the recover operation is started for the driver 332 at the position D11. The former 333 part way is re-interlocked and returned to the position D0 which is equivalent to the initial position passing through the positions of D12 and D13.

The anvil unit 350 recovery operation is started slightly delayed to the recovery operation of the driver 332 and is returned to the position A7 which is equivalent to the initial position passing through the position A6.

Finally, the anvil unit 360 recovery operation is started slightly delayed to the recovery operation of the driver 350 and is returned to the position C4 which is equivalent to the initial position to complete the series of the staple operation.

According to the above embodiment, it is possible to attain the timing to stop the drive motor and when outputting the drive motor stop signal, to actually consider the inertia acting on the binding means to output a drive motor stop signal at the timing to securely recover the binding means within the idling position region.

Also, it is possible to preset the idling position region to idle the binding means to a region of no operation to the drive of the drive motor on the cam rotating plate which is the interlock means to interlock the drive motor and the binding means centering on the reciprocal movement of the binding means.

It is also possible to provide an electric stapler apparatus as a stationary product that can use a built in control means for controlling the drive motor drive on the stapler apparatus itself

The invention claimed is:

1. A stapler apparatus for recovering a binding means reciprocally driven by a drive motor to an idling position region by inertial movement after a stop of the drive motor, the stapler apparatus comprising:

an idling position sensor means for detecting the recovery of said binding means within the idling position region; and an actuating position sensor means for detecting an actuating position of said binding means before the idling position region;

said stapler apparatus can attain a timing to stop the drive motor based upon the output of at least one of said idling position sensor and said actuating position sensor.

2. The stapler apparatus according to claim 1, further comprising an interlock means for interlocking said drive motor and said binding means, a region centered on the reciprocal movement of the binding means wherein there is no drive of the drive motor, the region being said idling position region.

3. The stapler apparatus according to claim 2, wherein said interlock means comprises a cam rotating plate rotatingly driven by the drive motor.

4. The stapler apparatus according to claim 1, wherein each of the idling position sensor means and the actuating position sensor means includes an optical sensor.

5. A stapler apparatus for recovering a binding means reciprocally driven by a drive motor to an idling position region by inertial movement after a stop of the drive motor, the stapler apparatus comprising:

an idling position sensor means for detecting the recovery of said binding means within the idling position region;

an actuating position sensor means for detecting an actuating position of said binding means before the idling position region; and a stopping position sensor means for detecting a stop of the binding means within a region ranging from the actuating position of the binding means detected by said actuating position sensor means to the idling position region detected by said idling position sensor means;

wherein, when restarting after stopping partway, other than when said stopping position sensor means detects a stop of the binding means, said drive motor drives in a direction opposite the normal direction of rotation, but based on the first output of the outputs of either said idling position sensor means or the actuating position sensor means or when a stop is detected, said drive motor drives in the direction of normal rotation, the staple apparatus attains the timing to stop the drive motor based upon the output of said idling position sensor means output.

6. The stapler apparatus according to claim 5, wherein each of the idling position sensor means, the actuating position sensor means, and the stopping position sensor means includes an optical sensor.

7. The stapler apparatus according to claim 5, further comprising an interlock means for interlocking said drive motor and said binding means, a region centered on the reciprocal movement of the binding means wherein there is no drive of the drive motor, the region being said idling position region.

8. The stapler apparatus according to claim 7, wherein said interlock means comprises a cam rotating plate rotatingly driven by the drive motor.

* * * * *